US008776265B2

(12) United States Patent
Neveu

(10) Patent No.: US 8,776,265 B2
(45) Date of Patent: Jul. 15, 2014

(54) INFANT SWADDLING SYSTEM AND METHOD

(76) Inventor: Jennifer Neveu, Nashua, NH (US)

( * ) Notice: Subject to any disclaimer, the term of this patent is extended or adjusted under 35 U.S.C. 154(b) by 340 days.

(21) Appl. No.: 12/848,183

(22) Filed: Aug. 1, 2010

(65) Prior Publication Data

US 2012/0023637 A1 Feb. 2, 2012

(51) Int. Cl.

| | |
|---|---|
| ***A41D 11/00*** | (2006.01) |
| ***A41B 13/06*** | (2006.01) |
| ***A47G 9/06*** | (2006.01) |

(52) U.S. Cl.

CPC ..... *A41B 13/06* (2013.01); *A47G 9/068* (2013.01)

USPC ..... 2/75; 2/69.5

(58) Field of Classification Search

CPC ..... A41B 13/06; A41B 13/065; A47G 9/083; A41D 10/00

USPC ..... 2/75, 80, 111, 87, 88, 69, 69.5; 5/494, 5/655, 482

See application file for complete search history.

(56) References Cited

U.S. PATENT DOCUMENTS

| | | | | |
|---|---|---|---|---|
| 3,739,399 | A * | 6/1973 | Sheahon | 2/69.5 |
| 5,722,094 | A | 3/1998 | Ruefer | |
| 6,640,340 | B2 | 11/2003 | Gibson | |
| 6,839,924 | B2 | 1/2005 | Sims | |
| 6,928,674 | B2 | 8/2005 | Blackburn | |
| 7,076,819 | B2 | 7/2006 | Trani et al. | |
| 7,246,392 | B2 | 7/2007 | Schmid et al. | |
| 7,254,849 | B1 | 8/2007 | Fiebrich et al. | |
| 7,587,769 | B1 | 9/2009 | McDermott | |
| D613,106 | S | 4/2010 | Ward et al. | |
| 7,954,187 | B1 * | 6/2011 | Earnest | 5/494 |
| 8,302,225 | B1 * | 11/2012 | Earnest | 5/494 |
| 2007/0157392 | A1 | 7/2007 | Ragen | |
| 2010/0071709 | A1 | 3/2010 | Grissom | |
| 2011/0179546 | A1 * | 7/2011 | Millette et al. | 2/75 |

FOREIGN PATENT DOCUMENTS

| | | |
|---|---|---|
| WO | WO 2004075619 | 9/2004 |
| WO | WO 2006125255 | 11/2006 |

* cited by examiner

*Primary Examiner* — Khoa Huynh
*Assistant Examiner* — Anna Kinsaul
(74) *Attorney, Agent, or Firm* — Luis Figarella

(57) ABSTRACT

A swaddling system and method for use when swaddling the upper and lower torso of an infant separately. The system is equipped with fasteners that allow the upper and lower torso portions to be secured separately, and to allow for the changing of diapers without unwrapping the upper torso. In addition, the system allows for the partial swaddling of an infant while in a car or stroller seat.

4 Claims, 6 Drawing Sheets

INFANT SWADDLING SYSTEM AND METHOD

TECHNICAL FIELD

The present invention generally relates to a swaddling system and method of its use for infants, and specifically to items of clothing and wear for the use in securing an infant's extremities.

BACKGROUND

Swaddling is the practice of wrapping infants snugly in blankets, towels or similar cloth items so that movement of the limbs is tightly restricted. It is believed to improve the baby's comfort by simulating the sensations babies had in their mother's womb or parent's arms.

Conventional rectangular baby blankets can be used to swaddle and infant, but they suffer from a number of limitations in the ease of application and wear. Such blanket's limitations include overheating or discomfort (primarily caused by excess of material, difficulty in folding and attaching the swaddle blanket in order to achieve a good wrap and lack of good fit around the infant's neck and shoulders.

A number of attempts have been conceived in the prior art, including Cassey (WO 2006/125255), Sims (U.S. Pat. No. 6,839,924), Grissom (U.S. Pub. No. 2010/0071709), Trani et al (U.S. Pat. No. 7,076,819), Schmid et al (U.S. Pat. No. 7,264,392) and McDermott (U.S. Pat. No. 7,587,769), the contents of all of them being incorporated by reference in their entirety.

A particular want in the prior art is the ability to both secure the infant's legs while providing the ability to inspect (and possibly change) a diaper without unwrapping the infant's arms. In short, they either ignore the lower torso, or cover it in a way that makes the above difficult. These limitation are born out of the shape as well as the closure methods selected (and their placement), yet are corrected and easily performed in the applicant's submission.

SUMMARY OF THE INVENTION

This section is for the purpose of summarizing some aspects of the present invention and to briefly introduce some preferred embodiments. Simplifications or omissions may be made to avoid obscuring the purpose of the section. Such simplifications or omissions are not intended to limit the scope of the present invention.

In one aspect the invention provides an infant swaddling system comprising a first rectangular strip of material having a first end and a second end, with said first strip having an interior surface that faces an infant's body when swaddled, an exterior surface on the opposite side of the interior surface, a longitudinal axis extending from the first end to the second end, wherein the length of the first strip from the first end to the second end is sufficiently long to surround the infant's upper torso at least one time.

One or more first end fasteners located near the edge of the interior surface of the first end of said first strip for detachable engagement with an infant's clothing along a first side of the upper torso lateral area, one or more second fasteners located at a distance approximately one width of an infant's torso along the length of the interior surface of said first strip for detachable engagement with an infant's clothing along the second side of the upper torso lateral area, said second side of the upper torso being opposite the first side of the upper torso, one or more third fasteners located significantly near the second end of said first strip, along the interior surface for detachable engagement with the exterior surface of said first strip along the upper torso lateral area.

In one aspect, a similar second rectangular strip of material having a first end and a second end, said second strip having an interior surface that faces an infant's body when swaddled, an exterior surface on the opposite side of the interior surface, a longitudinal axis extending from the first end to the second end, wherein the length of the second strip from the first end to the second end is sufficiently long to surround the infant's lower extremities at least one time, one or more first end fasteners located near the edge of the interior surface of the first end of said second strip for detachable engagement with an infant's clothing along a first side of the infant's lower extremities lateral area.

One or more second fasteners located at a distance approximately one width of an infant's lower extremities along the length of the interior surface of said second strip for detachable engagement with an infant's clothing along the second side of the infant's lower extremities lateral area, said second side of the lower extremities being opposite the first side of the lower extremities, and one or more third fasteners located significantly near the second end of said second strip, along the interior surface for detachable engagement with the exterior surface of said second strip along the infant's lower torso as well as the lower extremities area.

In another aspect, the fasteners comprise hook and loop fasteners. In one aspect, one or more hook fasteners are attached to the infant's clothing along both sides of upper torso, one or more hook fasteners are attached to the infant's clothing along both sides of the lower extremities, the one or more said third fasteners are hook fasteners; and the one or more first fasteners, as well as the one or more second fasteners are loop fasteners.

In another aspect one or more loop fasteners are attached to the infant's clothing along both sides of upper torso, one or more loop fasteners are attached to the infant's clothing along both sides of the lower extremities, the one or more said third fasteners are loop fasteners and the one or more first fasteners, as well as the one or more second fasteners are hook fasteners.

In another aspect, a baby sleeper, sleeping suit, onesie, overall or article of clothing containing the matching detachable fasteners to those in the strips is provided. In another aspect, the strips of material are permanently connected to the infant's clothing article, such as said sleeper, sleeping suit, onesie, shirt or diaper. In yet another aspect, the diaper is a disposable diaper having a built in, permanently connected swaddling strip of material suitable for covering the infant's lower torso and extremities. In another aspect, the first and second strips of material are permanently joined at one end. In one aspect, this joining is not permanent, but effected by detachable means.

In one aspect, the invention is about a method of using the system described, where the supplied items are used to securely swaddle an infant's lower extremities and upper torso separately Other features and advantages of the present invention will become apparent upon examining the following detailed description of an embodiment thereof, taken in conjunction with the attached drawings.

DETAILED DESCRIPTION

To provide an overall understanding of the invention, certain illustrative embodiments will now be described, including apparatus and methods for displaying images. However, it will be understood by one of ordinary skill in the art that the systems and methods described herein may be adapted and modified as is appropriate for the application being addressed and that the systems and methods described herein may be employed in other suitable applications, and that such other additions and modifications will not depart from the scope hereof.

Figure 1:
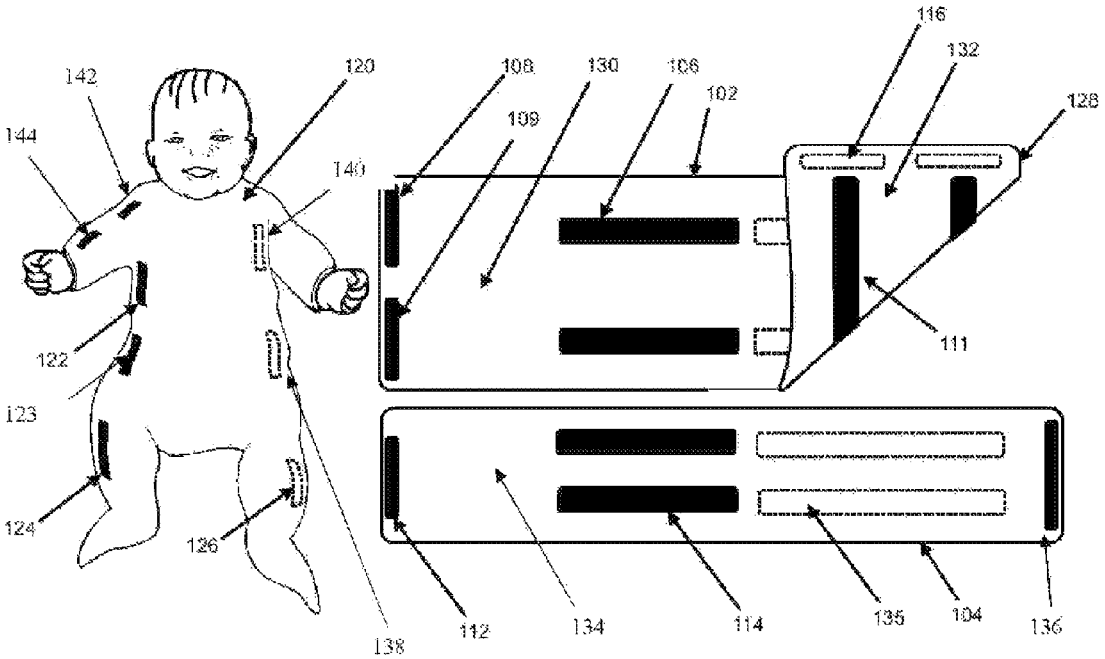
FIG. 1 shows an illustration of the swaddling system according to an exemplary embodiment of the invention.

FIG. 1 illustrates an exemplary embodiment of the swaddling system. In one embodiment, the systems is comprised of a first upper torso or upper extremities piece 102, and a second lower torso or lower extremity piece 104. Both said first and second pieces are comprised of significantly rectangular strips of material, which may be natural (e.g. cotton) or man-made/synthetic (polyester and others). In one embodiment, the pieces are meant to be re-usable. In an alternate embodiment, one or more of the pieces are meant to be disposable, and made of paper, plastic or other synthetic or man-made materials.

In an alternate embodiment, the outer portions of the strips are made of a reusable material (natural or man-made), with a disposable inner lining made of paper or other absorbent material, in order to allow its easy replacement if soiled or compromised. In another embodiment, a disposable diaper has a permanently attached lower torso strip.

Said strips of material have an interior surface (130, 134) that faces an infant's body when swaddled, an exterior surface (132) on the opposite side of the interior surface, a longitudinal axis extending from the first end to a second end (128), wherein the length of the strips from the first end to the second end is sufficiently long to surround the infant's upper torso (including the upper extremities) and lower torso (including the lower extremities) at least one time.

In addition to said strips, a number of optional portions for the system include a number of attachable/detachable securing means designed for secure attachment to the infant's clothing. In an alternate embodiment, clothing items such as coveralls, onesies, sleeper, sleeper suit (120), tops and bottoms, diapers and others item of infant's or baby clothing are specifically modified to contain the securing means within them permanently.

The upper torso piece, or first strip 102, has an inner or interior side 130. Within this inner side sit at or near the edge of the first end one or more first detachable fasteners (108, 109), one or more second detachable fasteners 106, as well as one or more third detachable fasteners 116, located at or near the second end's edge. The one or more second fasteners 106 are located so that their range or span of attachment is approximate to the frontal distance between the infant's torso, taking into consideration the length of the arm or arms to be swaddled.

In one embodiment, this distance is from the outside edge or back of the arms across the chest, where the first fasteners 108 are meant to be attached. In an alternate embodiment, this is the distance across the torso starting below the underarms (or axila), while immobilizing one or more of the infant's arms. In many items of clothing, this can be seen as the distance at or between the seams that make the garment, which usually meet mid-torso. Of course, the one or more second attachment means 106 must account for the infant's accelerated rate of body development. For this reason, as shown in the exemplary embodiment of FIG. 1, a lengthwise adjustable attachable fastener is preferred.

The second strip 104 has similar devices on it. Its inner side 134 is similarly defined as that of the first strip 102 and the outer side on it's opposite side. In one embodiment, the inner side has one or more first fasteners 112, one or more second fasteners 114, and one or more third fasteners 136 on said inner side. In an alternate embodiment, one or more fourth fasteners 135 are located on the outer or exterior side.

The securing means may be comprised of hook-and-loop fasteners (such as Velcro), mechanical fasteners (such as snaps, buttons, clips), tape, smooth surfaces, hooks, loops or other means for securing in place the material of the first 102 and second 104 strips. Each securing means position, such as the second fastener 106, may be comprised of one or more portions of securing means, placed significantly along the width of the strips (102, 104). Thus as in the exemplary embodiment shown in FIG. 1, the securing means placed in position 112 consist of a single strip of Velcro that significantly spans the width of the lower torso piece 114, while the similar position on the upper torso piece (108) is comprised in the example of two axially aligned pieces (108, 109).

When using loops and hooks fastening means, one or more fourth fasteners 111 are placed within the exterior or outer side 132 of the first strip, at or along the edge of the second end. Similarly for the second strip. In a hook and loop arrangement, this fourth fastener is intended to be complementary to the third fastener 116. When using hooks and loops, it is only important that the third and fourth fasteners be complementary (one be loop, the other hook), as well as the first and second be complementary to the fasteners on the infant's clothing. All other possible combinations may be tried.

When using hook-and-loop fasteners, hooks are preferred for the inner surface fasteners, with loops being preferred in the outer surface fasteners. In an alternate embodiment, the reverse is used, with loops in the inner surfaces, and hooks in the outer surfaces. In one embodiment, the second 106, 114 and fourth 111, 135 fasteners are rectangular. These may be placed significantly parallel to the longitudinal axis of the strips, or at any angle up to and including perpendicular.

In one embodiment, complementary securing means are built-into the infant's clothing 120 (or securely attached to it) as shown in FIG. 1. This allows for the safe and comfortable attachment of the upper/lower torso complementary fasteners (for example when using hooks and loops), or reusable tape plastic surfaces. Thus one or more complementary fastening areas (138, 140) for attachment of the first (108, 109) fasteners (when swaddling from the baby's left to right) [this area would be for attachment of the one or more second fasteners 106 if swaddling from the baby's right to left]. Similarly, the lower torso strip is has it's first fastener 112 secured to its complementary area 126.

To complete the first phase of the swaddling when going left to right (from the infant's perspective), one or more of the second fasteners 106 is attached to the infant's clothing complementary area 122, 123 (for the upper torso) and 124 for the lower torso or second strip. In one embodiment, these are also located below the axila. In an alternate embodiment, they may be located in the side or rear quadrant of the sleeve (142, 144) as shown in FIG. 1.

Figure 2:
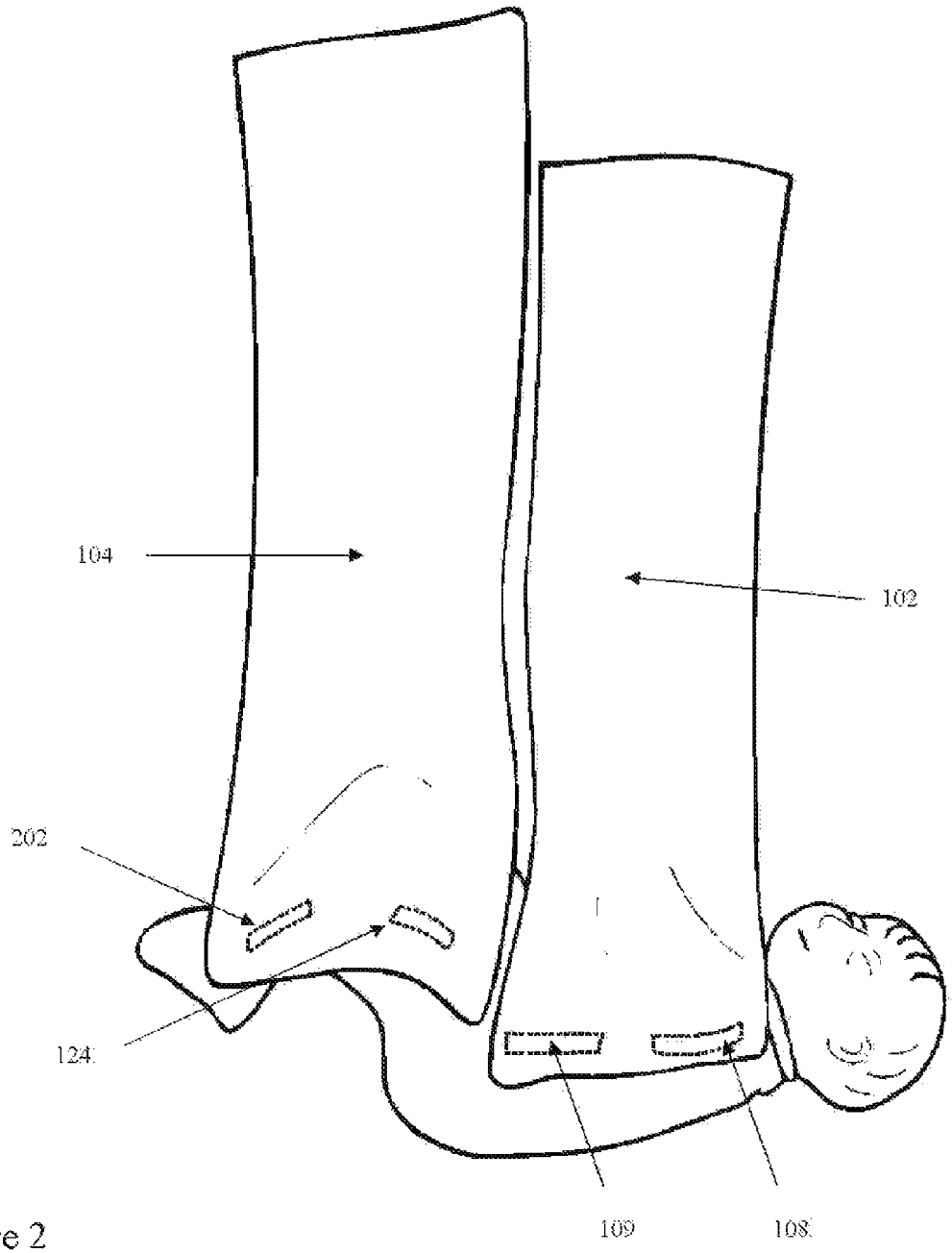
FIG. 2 shows an illustration of the swaddling system attached to one side of the upper and lower torso of an infant according to exemplary embodiments of the invention.

In one embodiment (FIG. 2) the swaddling process begins by attaching the first strip 102 first fasteners (108, 109) to their complementary securing areas (108 to 140, 109 to 138). Similarly (although not necessarily at the same time), the second strip 104 first fastener 112 is attached to its complementary area 126. Note that in an alternate embodiment, said first fastener may have a second hook/loop unit 202. In one embodiment, these securing means are attached on the infant's garment portion around the torso side, below the underarm (or axila), and preferably slightly behind the arms. This allows for the tightest possible swaddling with the first strip 130 portion on the upper torso. In an alternate embodiment, the clothing securing means may be placed on the sides of the arm sleeves. In an alternate embodiment, the above securing means are included with the infant's clothing.

In one embodiment, one or more of the inner edge securing means 108 (if present, 109) of the upper torso piece are then connected to the infant's left-side clothing securing means on one side of the infant (120, 126), and the inner side of the first strip 130 laid across the infant's chest, taking care to place the infant's arm within it, and if possible in an up/down orientation. The one or more middle inner side securing means 106 are then secured to the infant's right-side clothing securing means (122, 124). (Left-handed caregivers may perform the procedure by rotating the torso portion and beginning from left to right).

Figure 3:
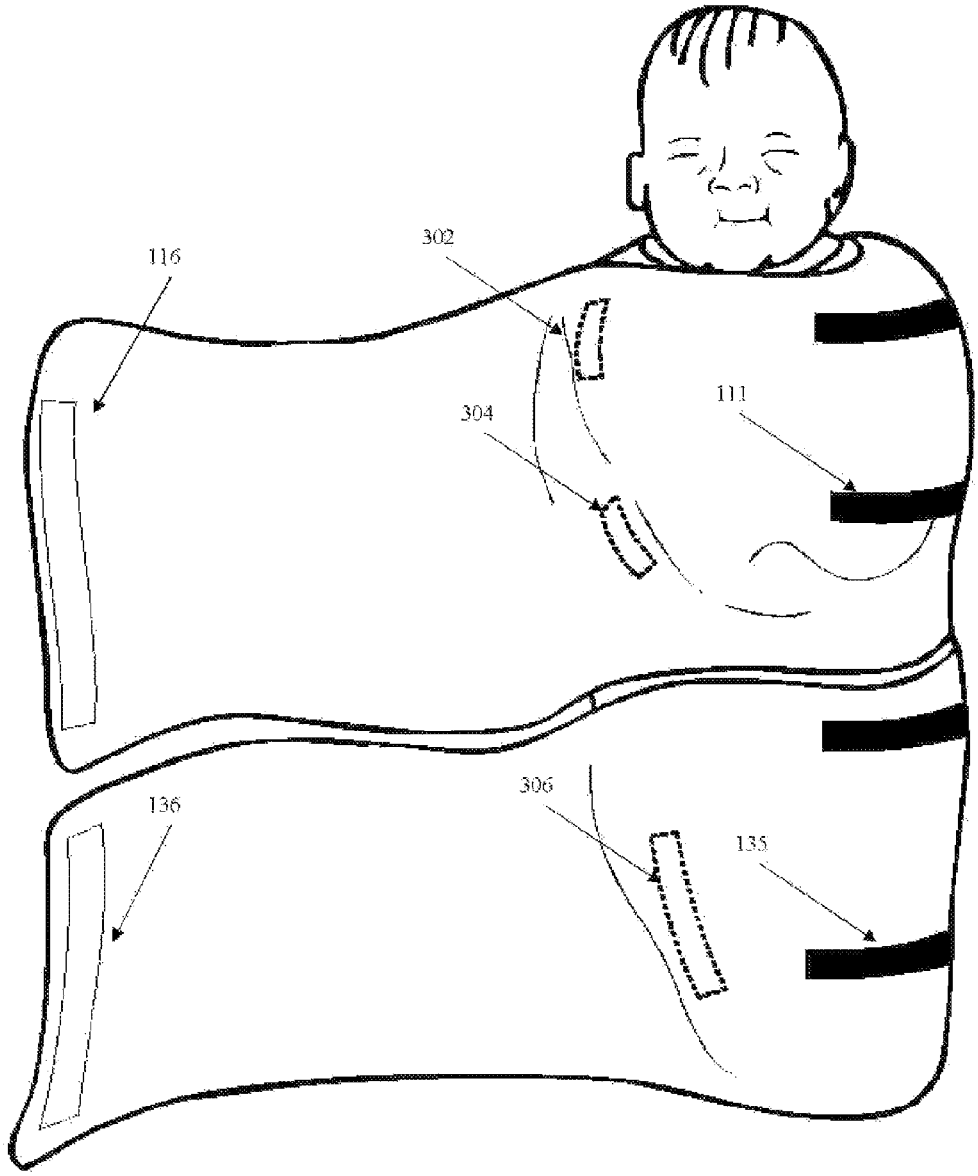
FIG. 3 shows an illustration of the swaddling system attached to the front upper and lower torso and extremities of the infant according to an exemplary embodiments of the invention.

The inner side 130 of the first strip 102 is pulled tight across the infant's upper torso via attachment (as seen in FIG. 3) at one or more of the coupled anchor points per side (302, 304 and 306), where point 302 is the attachment of fastener 108 in one embodiment. Or the complement of hook/loop fastener 108 and its area 122 (302), as well as 109 with 123 (304) in the upper torso. As well as 306 in the lower torso, similarly being the fastener 114, or the hook/loop combination 114 to 124.

Figure 5:
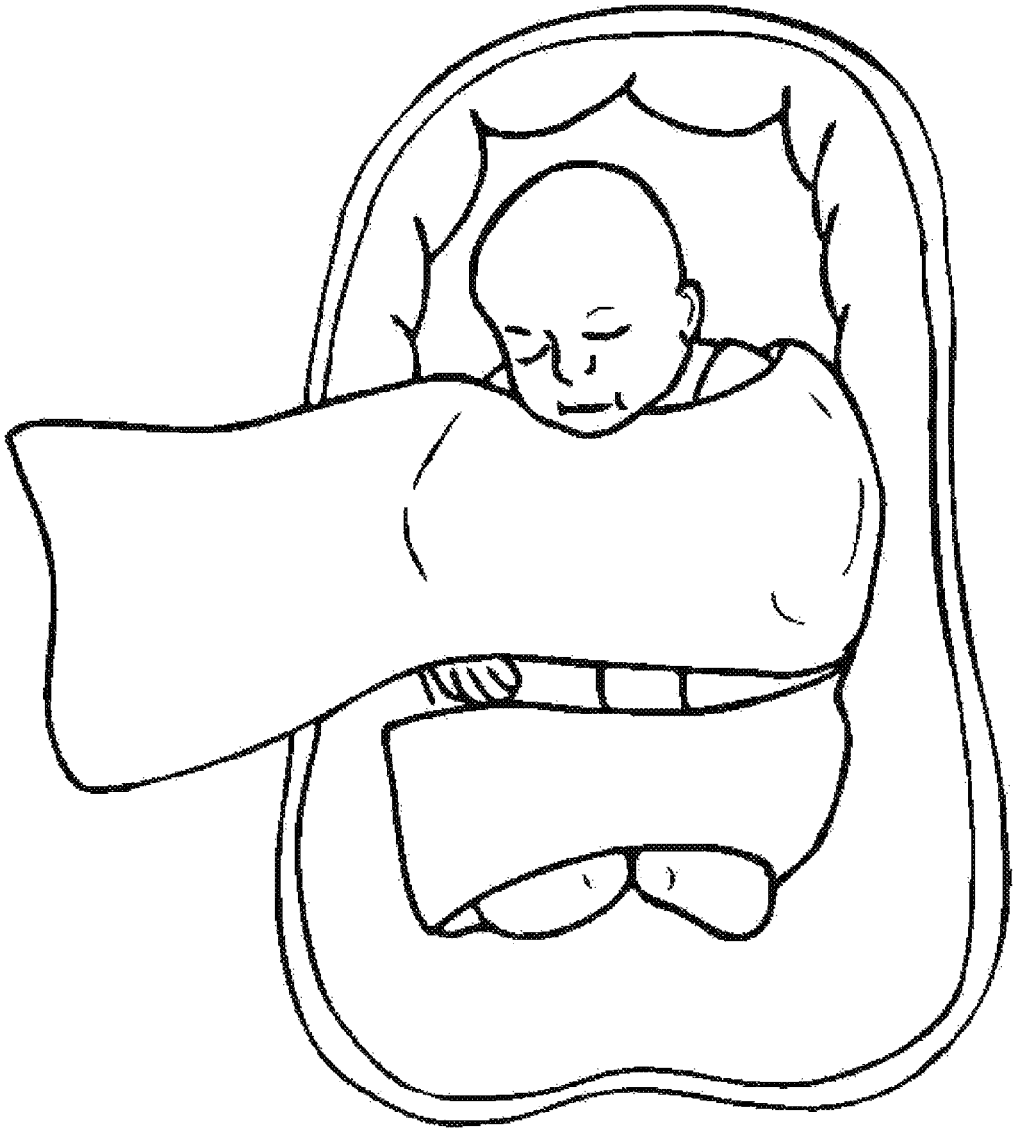
FIG. 5 shows an illustration of the swaddling system partially swaddling the infant across the front of the torso while the infant is in a car seat, carrier or swing according to an exemplary embodiments of the invention.

The above embodiment has the advantage of generating significant restraining force on the infant's extremities, even when the upper torso piece is nor completely "wrapped" around the child. As seen in FIG. 5 one of its advantages is that it provides a solution which works exceptionally well in an infant's car or stroller seat, where the complete circumference of the child is either impossible or undesirable because of the restraining safety means.

Figure 4:
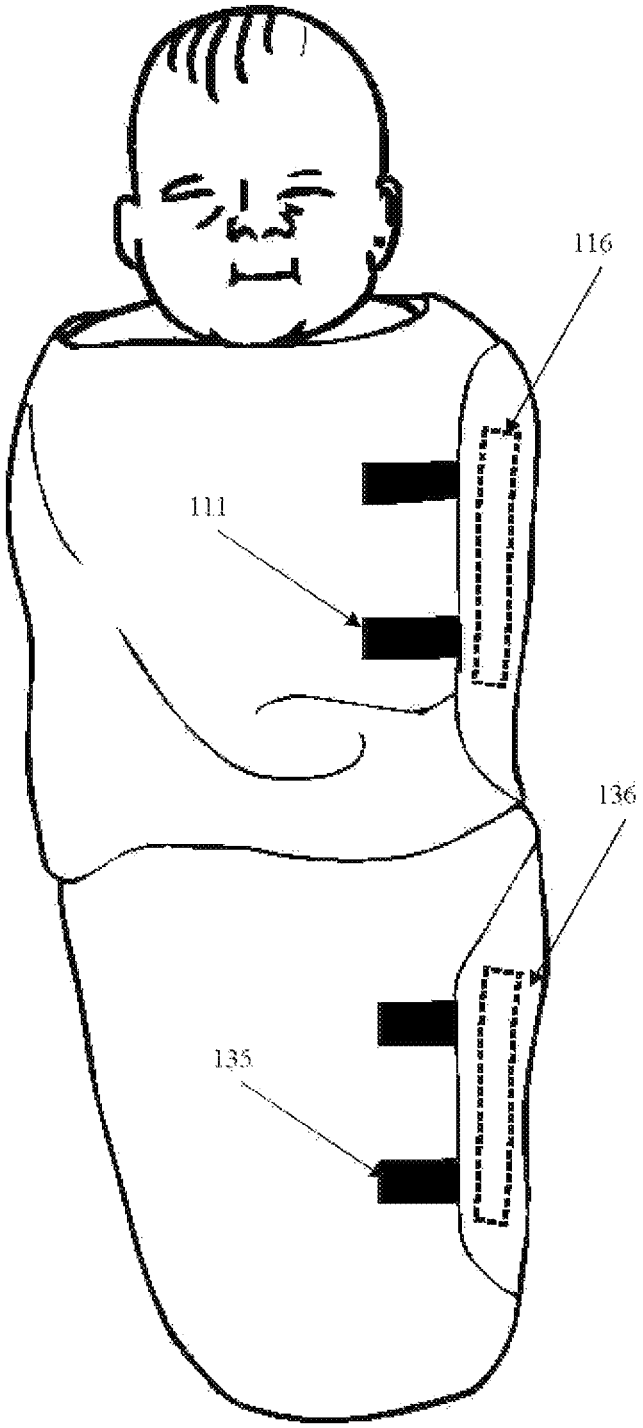
FIG. 4 shows an illustration of the swaddling system completely looped around the infant according to exemplary embodiments of the invention.

When the complete circumference is desired, the swaddling process continues by taking the upper torso portion 102 and surrounding the child's upper torso completely using as many revolutions of said upper torso portion 102 as required or available. In one embodiment, 1½ revolutions is optimal. When the end is reached, (FIG. 4) in one embodiment, hooks are used on the outer securing means 116.

In an alternate embodiment, where hooks and loops fasteners are used, the one or more inner face securing means 116 are secured to their complementary loop or hook outer face securing means 111. These one or more securing mean pairs provide for a securing of the upper torso piece 102.

In an alternate embodiment, all or parts of the outer side of the upper torso piece is equipped or created with hooks or loops, so that complementary elements in securing means locations 106 and 116 may attach securely independent of the diameter of the child.

The same procedure (FIG. 4) is followed in securing the lower torso piece 104, by securing its inner edge 112 to the securing means within the infant's leg securing mean 126. In one embodiment, the leg securing mean 126 is placed along the outside of the infant's pant leg.

In one embodiment, either the upper 102 or lower 104 torso pieces are permanently secured (via stitching, gluing, or mechanical fixtures affixing) to the items of clothing. 120, and are either made of re-usable materials (such as natural or man made fibers). In an alternate embodiment, the lower torso portion 104 is permanently attached to a disposable diaper, and made of a similar disposable material. Thus a parent may decide to dress the infant with a re-usable and detachable upper torso portion 102, whereas the a disposable, permanently attached lower torso portion 104 designed to be thrown away with the soiled diaper and replaced by a new one is used.

In an alternate embodiment the lower torso piece 104 is initially secured to securing means attached to the infant's diaper sides, with the tension against the lower legs coming from the "tubing" effect created by one or more revolutions of said lower torso piece 102 against the infant's legs. In one embodiment, there is no securing against the infant's lower torso, but instead the similar "tubing" effect is accomplished by the pairing of securing means 135 to 136. In an alternate embodiment, both upper and lower strip portions are looped 1½ times around the infant's body, with the end being all or partially attached to some or all of the fastening means at the infant's other side.

Figure 6:
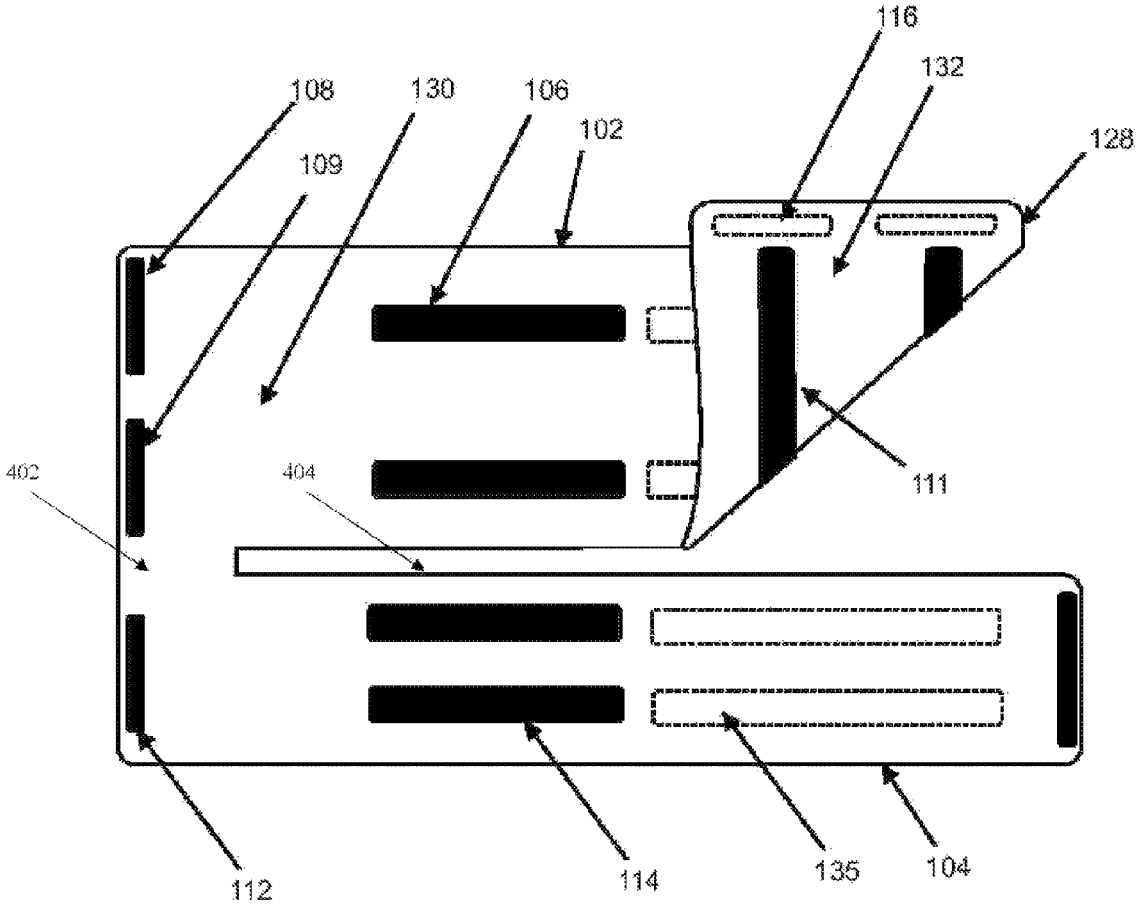
FIG. 6 shows an illustration of the swaddling system with both pieces attached along an edge according to an exemplary embodiment of the invention.

In an alternate embodiment seen in FIG. 6, the first strip 102 is joined to the second strip 104 by removable means around the first edge area 402. This may be accomplished by a strip with two buttons that go into button holes, by clip-on buttons that have a complementary receiver in each strip, by a rectangular piece with alligator clips on both ends, etc. In an alternate embodiment, this is a permanent part of the strips, making a single piece with a slit 404 separating the first and second strips. This allows for the easy release of the lower portion (as before, while keeping the upper portion of the infant swaddled), without any concern of it "blowing" away or being misplaced.

Various embodiments and features of the present invention have been described in detail with a certain degree of particularity. The utilities thereof can be appreciated by those skilled in the art. It should be emphasized that the above-described embodiments of the present invention merely describe possible examples of the implementations to set forth a clear understanding of the principles of the invention, and that numerous changes, variations, and modifications can be made to the embodiments described herein without departing from the spirit and scope of principles of the invention. Also, such variations and modifications are intended to be included herein within the scope of the present invention, as set forth in the appended claims. The scope of the present invention is defined by the appended claims, rather than the forgoing description of embodiments. Accordingly, what is desired to be secured by Letters Patent is the invention as defined and differentiated in the following claims, and all equivalents.

I claim:

1. An infant swaddling system comprising:

an infant's article of clothing having an upper torso portion to surround and cover an infant's upper extremities and a lower torso portion to surround and cover an infant's lower extremities, the infant's article of clothing having hook and loop fasteners along sides of the upper and lower torso portions; and a first rectangular strip of material having a first end and a second end, an interior surface that faces said infant's article of clothing upper torso portion when swaddled, and an exterior surface opposite the interior surface, a longitudinal axis extending from said first end to said second end of the first strip, wherein the length of said first strip of material from said first end to said second end is sufficiently long to swaddle the infant's upper extremities;

one or more first hook and loop fasteners located along the first strip first end on the first strip interior surface, said first hook and loop fasteners of the first strip being complementary to said hook and loop fasteners on said infant's article of clothing upper torso portion;

one or more second hook and loop fasteners on said first strip interior surface, said second hook and loop fasteners of the first strip shaped in an elongated fashion parallel to the longitudinal axis and located at a distance approximately one width of an infant's torso and being complementary to the hook and loop fasteners on said infant's article of clothing upper torso portion such that said first rectangular strip is configured to secure both arms of said infant once said first and second fasteners of the first strip are secured to said infant's complementary upper torso fasteners;

one or more third hook and loop fasteners on said first strip second end on the first strip interior surface;

one or more fourth hook and loop fasteners located near said first strip second end on the first strip exterior surface, said fourth hook and loop fasteners of the first strip shaped in an elongated fashion parallel to the longitudinal axis, said fourth hook and loop fasteners of the first strip being complementary to said third hook and loop fasteners on the first strip;

a second rectangular strip of material having a first end and a second end, an interior surface that faces said infant's article of clothing lower torso portion when swaddled, and an exterior surface opposite the interior surface, a longitudinal axis extending from said first end to said second end of the second strip, wherein a length of said second strip of material from said first end to said second end is sufficiently long to swaddle the infant's lower extremities;

one or more first hook and loop fasteners located along the second strip first end on the second strip interior surface, said first hook and loop fasteners of the second strip being complementary to said hook and loop fasteners on said infant's article of clothing lower torso portion;

one or more second hook and loop fasteners on said second strip interior surface, said second hook and loop fasteners of the second strip shaped in an elongated fashion parallel to the longitudinal axis and located at a distance approximately one width of an infant's torso and being complementary to the hook and loop fasteners on said infant's article of clothing lower torso portion such that said second rectangular strip is configured to secure both hips of said infant once said first and second fasteners of the second strip are secured to said infant's complementary lower torso fasteners;

one or more third hook and loop fasteners on said second strip second end on the second strip interior surface;

one or more fourth hook and loop fasteners located near said second strip second end on the second strip exterior surface, said fourth hook and loop fasteners of second strip shaped in an elongated fashion parallel to the longitudinal axis, said fourth hook and loop fasteners of the second strip being complementary to said third hook and loop fasteners on the second strip; and wherein the first and second rectangular strips are connected at their first ends.

2. The infant swaddling system of claim 1 wherein the first and second rectangular strips of material are separated from each other for at least two thirds of their lengths by a slit.

3. An infant swaddling system comprising:

an infant's article of clothing having an upper portion to surround and cover an upper torso of an infant and a lower portion to surround and cover a lower torso of an infant, the infant's article of clothing having fasteners along sides of the upper and lower portions; and a first swaddling wrap of a first predetermined size and configuration sufficient to wrap around and swaddle the upper torso of an infant, said first swaddling wrap having a first end and a second end, an interior surface that faces said infant's article of clothing upper portion when swaddled, and an exterior surface opposite the interior surface, a longitudinal axis extending from said first end to said second end of the first swaddling wrap, wherein a length of said first swaddling wrap from said first end to said second end is sufficiently long to swaddle the infant's upper torso;

a first set of fasteners located along the first swaddling wrap first end on the first swaddling wrap interior surface, said first set of fasteners of the first swaddling wrap being complementary to said fasteners on said infant's article of clothing upper portion;

a second set of fasteners on said first swaddling wrap interior surface, said second set of fasteners of the first swaddling wrap shaped in an elongated fashion parallel to the longitudinal axis and located at a distance approximately one width of an infant's torso and being complementary to the fasteners on said infant's article of clothing upper portion such that said first swaddling wrap is configured to secure both arms of said infant once said first and second set of fasteners of the first swaddling wrap are secured to said infant's complementary upper portion fasteners;

a third set of fasteners on said first swaddling wrap second end on the first swaddling wrap interior surface;

a fourth set of fasteners located near said first swaddling wrap second end on the first swaddling wrap exterior surface, said fourth set of fasteners on the first swaddling wrap shaped in an elongated fashion parallel to the longitudinal axis, wherein said fourth set of fasteners of the first swaddling wrap being complementary to said third set of fasteners on the first swaddling wrap for attaching to each other after said first swaddling wrap is wrapped around the upper torso of said infant at least one time; and a second swaddling wrap of a second predetermined size and configuration sufficient to wrap around and swaddle the lower torso of an infant, said second swaddling wrap having a first end and a second end, an interior surface that faces said infant's article of clothing lower portion when swaddled, and an exterior surface opposite the interior surface, a longitudinal axis extending from said first end to said second end of the second swaddling wrap, wherein a length of said second swaddling wrap of material from said first end to said second end is sufficiently long to swaddle the infant's lower torso;

a first fastener located along the second swaddling wrap first end on the second swaddling wrap interior surface, said first fastener of the second swaddling wrap being complementary to said fasteners on said infant's article of clothing lower portion;

a second set of fasteners on said second swaddling wrap interior surface, said second set of fasteners of the second swaddling wrap shaped in an elongated fashion parallel to the longitudinal axis and located at a distance approximately one width of an infant's torso and being complementary to the fasteners on said infant's article of clothing lower portion such that said second swaddling wrap secures both hips of said infant once said first and second fasteners of the second swaddling wrap are secured to said infant's complementary lower portion fasteners;

a third fastener on said second swaddling wrap second end on the second swaddling wrap interior surface;

a fourth set of fasteners located near said second swaddling wrap second end on the second swaddling wrap exterior surface, said fourth set of fasteners of said second swaddling wrap shaped in an elongated fashion parallel to the longitudinal axis, wherein said fourth set of fasteners of the second swaddling wrap being complementary to said third fastener on the second swaddling wrap for attaching to each other after said second swaddling wrap is wrapped around the lower torso of said infant at least one time; and wherein the first and second swaddling wraps are permanently attached at their first ends; and said first swaddling wrap and said second swaddling wrap co-acting to swaddle the body of an infant but permitting said second swaddling wrap to be un-swaddled to facilitate access to a lower extremity of an infant while the upper torso of the infant is swaddled by said first swaddling wrap.

4. The infant swaddling system of claim 3 wherein first swaddling wrap and second swaddling wrap are separated from each other for at least two thirds of their lengths by a slit.

* * * * *